US007677259B1

(12) United States Patent
Arbuckle et al.

(10) Patent No.: US 7,677,259 B1
(45) Date of Patent: Mar. 16, 2010

(54) CRUTCH WALKER AND ASSOCIATED USE THEREFOR

(76) Inventors: Jetta E. Arbuckle, 4891 S. Pacini Ct., Pahrump, NV (US) 89061; David M. Arbuckle, 4891 S. Pacini Ct., Pahrump, NV (US) 89061

( * ) Notice: Subject to any disclaimer, the term of this patent is extended or adjusted under 35 U.S.C. 154(b) by 7 days.

(21) Appl. No.: 12/152,783

(22) Filed: May 16, 2008

(51) Int. Cl.
*A61H 3/00* (2006.01)

(52) U.S. Cl. ..... 135/67; 135/66; 135/73; 135/75; 135/85; 280/87.021

(58) Field of Classification Search ..... 135/66–68, 135/69, 71, 73, 75, 85; 482/66–69; 297/5–6; 280/87.021, 47.34
See application file for complete search history.

(56) References Cited

U.S. PATENT DOCUMENTS

| | | | | | |
|---|---|---|---|---|---|
| 1,307,058 | A | * | 6/1919 | McGrath | 297/5 |
| 1,917,440 | A | * | 7/1933 | Finkbeiner et al. | 297/6 |
| 2,634,790 | A | * | 4/1953 | Elle | 135/67 |
| 2,759,525 | A | | 8/1956 | Riles | |
| 2,796,916 | A | | 10/1957 | Womble | |
| 3,195,550 | A | * | 7/1965 | Ingalls et al. | 135/67 |
| 3,625,237 | A | | 12/1971 | Wertz | |
| 4,226,413 | A | * | 10/1980 | Daugherty | 482/67 |
| 4,248,256 | A | | 2/1981 | Thomas | |
| 4,251,105 | A | | 2/1981 | Barker | |
| 4,748,994 | A | | 6/1988 | Schultz et al. | |
| 4,830,035 | A | | 5/1989 | Liu | |
| 4,993,446 | A | | 2/1991 | Yarbrough | |
| 5,287,869 | A | * | 2/1994 | Wu | 135/25.1 |
| 5,411,044 | A | | 5/1995 | Andolfi | |
| 5,702,326 | A | * | 12/1997 | Renteria | 482/68 |
| D437,679 | S | | 2/2001 | Lisowski et al. | |
| D535,220 | S | | 1/2007 | Wu | |
| 2004/0020525 | A1 | * | 2/2004 | Lev | 135/66 |
| 2008/0029139 | A1 | * | 2/2008 | Pijanowski | 135/67 |

* cited by examiner

*Primary Examiner*—Winnie Yip
(74) *Attorney, Agent, or Firm*—Robert C. Montgomery

(57) ABSTRACT

An apparatus that combines the functionality of a walker with that of a single crutch is herein disclosed. The apparatus provides for one crutch that comes up from the side support of the walker and thus the side of the user's body and is adjustable in height, as is the walker support handles, such that the invention can be customized for any sized user. The adjustment is facilitated by use of spring pin slip fittings, and thus can be adjusted in a matter of minutes without tools. The crutch support can be easily moved from the right to left hand side of the walker by use of a removable clamp system. It is also envisioned that certain models of the invention can provide crutches on both the right and left hand side of the walker simultaneously, based upon the needs of the patient. When not in use or not needed, the invention folds up in a manner similar to a conventional walker thus providing a low profile for ease of storage.

18 Claims, 4 Drawing Sheets

CRUTCH WALKER AND ASSOCIATED USE THEREFOR

RELATED APPLICATIONS

The present invention was first described in a notarized Official Record of Invention on Jun. 26, 2007 that is on file at the offices of Montgomery Patent and Design, LLC, the entire disclosures of which are incorporated herein by reference.

FIELD OF THE INVENTION

The present invention relates generally to a walking assist device with a removable crutch attachable thereto both sides of said walker device to assist either a left handed user, a right handed user, or a user who requires the aid of said crutch on both sides of the walker device.

BACKGROUND OF THE INVENTION

Walkers are used everyday by the elderly, the disabled, and those recovering from surgery or illness. Walkers assist with ambulation and mobility, while providing independence and safety to the user. The usage of a walker requires that the user have use of both of their arms in order to move and place the walker with each step. Should the usage of one arm not be available, a person with limited ambulation is typically forced to utilize a wheelchair, which while providing some mobility, limits independence and may lengthen recovery time due to the lack of exercise associated with walking with a walker. Accordingly, there is a need for a means by which the heath benefits, mobility and independence associated with a walker can be provided to those users who have limited or no use of one arm or both arms. The development of the invention herein described fulfills this need.

U.S. Pat. No. D 535,220 issued to Wu discloses a walker with arm handles. This design patent does not appear to disclose a crutch walker that has a similar design to the instant invention nor does it appear to disclose an apparatus that supports a user by the axillary region of the body.

U.S. Pat. No. D 437,679 issued to Lisowski et al. discloses an adjustable walker cane. This design patent does not appear to disclose a crutch walker that has a similar design to the instant invention nor does it appear to disclose a walker with a crutch attachment.

U.S. Pat. No. 5,411,044 issued to Andolfi discloses a patient transfer walker which provides a crutch like support and a walker with wheels. It does not appear that this patent discloses a unitary walker embodiment with a crutch mechanism that is adaptable to one or both sides of the walker utilizing the mechanism disclosed herein. It also appears that the referenced patent discloses an apparatus that has its object the transfer of a user from the standing to seated position.

U.S. Pat. No. 4,993,446 issued to Yarbrough discloses a combination walker and crutch which appears to be two crutches joined together to form a walker. This patent does not appear to disclose a walker with a crutch attachment on the upper surface of the walker nor does it appear to disclose an apparatus capable of employing a crutch that can be utilized by only one side of a user.

U.S. Pat. No. 4,830,035 issued to Liu discloses a seesawly-controlled foldable walker. This patent does not appear to disclose a walker with a crutch attachment that can be employed on one side or both sides to assist a user in ambulation.

U.S. Pat. No. 4,748,994 issued to Schultz discloses a reversible walker device which appears to be a walker with handles to control the movement of the walker. This patent does not appear to disclose a device that possesses crutch attachment(s) to assist a user in support while ambulating.

U.S. Pat. No. 4,251,105 issued to Barker discloses a mobility aid. This patent does not appear to disclose a walker with crutch attachment to assist in supporting users while ambulating with the walker.

U.S. Pat. No. 4,248,256 issued to Thomas discloses a platform crutch attachment for an invalid walker. This patent does not appear to disclose a crutch attachment that supports a user by the axillary area of the user.

U.S. Pat. No. 3,625,237 issued to Wertz discloses an arm support for invalid walkers. This patent does not appear to disclose a crutch walker that supports a user by the axillary area of the user.

U.S. Pat. No. 2,796,916 issued to Womble discloses a folding walking aid. This patent does not appear to disclose a crutch walker with the ability to provide different configurations with respect to the crutch position nor does it appear to disclose a crutch attachment with two supports.

U.S. Pat. No. 2,759,525 issued to Ries discloses a multiple purpose invalid walker. This patent does not appear to disclose a crutch walker with the ability to provide different configurations with respect to the crutch position nor does it appear to disclose a crutch attachment with two supports.

The prior art appears to disclose various apparatus that support users while ambulating utilizing walkers, some of which provide support for the upper extremities. The prior art does not appear to describe a crutch walker with the ability to conform to user deficit in the upper extremities in the manner specified by the instant invention nor does the prior art appear to provide the upper body support that the instant invention possesses.

SUMMARY OF THE INVENTION

In view of the foregoing disadvantages inherent in the prior art, it has been observed that there is need for a crutch walker for individuals who have difficulty ambulating and lack functional use of one or more upper extremities.

It is an object of the crutch walker to assist people in ambulation who have difficulty walking and limited use of one or both upper extremities.

A further object of the crutch walker is to present an alternative to using a wheelchair to those who require assistance in ambulation and lack complete functional use of one or both upper extremities.

Yet still another object of the crutch walker to be conformable to the side of the user which possesses the limited use of an upper extremity. The crutch walker is also adaptable to those users who have limited use of both upper extremities.

An aspect of the crutch walker is comprised of a walker section and a crutch section. The crutch section may be provided on either side of the walker or on both sides of the crutch walker. The crutch section comprises a padded support which interconnects with a fore support brace and an aft support brace. The fore support brace and the aft support brace extend through a plurality of holes around a rubberized hand grip. The fore support brace and the aft support brace enter inside of a fore support sleeve and aft support sleeve. The fore support sleeve and the aft support sleeve are physically supported by the hand grip section on the top and the side cross sectional support on the bottom. The supports are physically strong enough to support the weight of even the heaviest user. The fore support brace and the aft support brace and the fore support sleeve and the aft support sleeve are circular in cross sectional area.

A further object of the crutch walker is that the height of the crutch section can be adjusted up and down with relation to the crutch section. This height adjustment is done by a height adjustment mechanism on the lower part of the fore support sleeve and the aft support sleeve. The height adjustment mechanism is a spring pin arrangement but other types of height adjustment mechanism such as, but not limited to, friction collars, stop pins, set screws and the like could be used. The height adjustment permits the crutch walker to be customized to the size of users.

A further aspect of the crutch walker is that the walker section is comprised of a hand grip section, a plurality of legs, side cross sectional support, and a plurality of front, interconnecting members.

Yet a further aspect of the crutch walker is adaptable to different configurations such as a right-handed user, a left-handed user or when using both hands due to the adjustable nature of the crutch walker. Regardless of desired configuration, the crutch section is independently adjustable with regards to height, and can accommodate users who lean to one side or another as a result of a physical shortcoming.

Still a further aspect of the crutch walker is the angled relationship between the fore support brace and the aft support brace to vertical. This angled relationship aids in the usage of the crutch section as it provides greater comfort and stability by keeping the user centered in between the crutch walker legs and prevents the crutch walker user from toppling over during any stumbles.

Yet still a further aspect of the crutch walker comprises four (4) holes in the hand grip section to accept the fore support brace and the aft support brace. It is envisioned that the crutch walker would be supplied with all four (4) holes regardless of the desired configuration. If one (1) set or even both sets of holes is left unused in a particular configuration, it is envisioned that a set removable rubber plugs would be provided to cover the unused holes.

A further aspect of the crutch walker further comprises a height adjustment mechanism comprising a spring-pin mechanism. An inner circular member which would be the fore support brace or the holes is located inside of a fore support sleeve or aft support sleeve. A mounting pin is provided and attached to the interior surface of the inner circular member. A spring is mounted on the exterior surface of the mounting pin and acts against the inner circular member and a cap assembly. The cap assembly is held within the inner circular member by use a flange as provided as a formed fitting on the cap assembly. A user can push the cap assembly in through an external opening on the outer circular member using only their fingers and/or thumbs; no tools are necessary. The inner circular member and the outer circular member can then be adjusted up or down as desired. The series of external openings may be spaced at any desired interval.

Yet a further object of the crutch walker is the ability to equip the crutch walker with optional accessories such as folding storage hinges, glide wheels, and height adjustable feet to enhance the performance and convenience of the crutch walker. These optional accessories are not necessary, to increase the usability of the crutch walker.

A method for installing and utilizing the crutch walker may be used by performing the following steps: adjusting the crutch walker for the physical size of the user by adjusting the height adjustable feet to provide an adequate height of the hand grip section; placing the crutch section on the right, left or both sides of the walker section using the holes for initial placement; adjusting the height of the padded support so that the padded support is located just underneath the user's armpits in a normal walking stance; placing one or both of their armpit areas upon the associated padded support and their hands upon the associated rubberized hand grip and walking in a forward fashion; straightening their body in an upright manner and picking up the entire crutch walker with each step and putting it down slightly forward of the previous position; using their legs and to walk forward; and, enjoying the convenience and security the crutch walker gives in assisting ambulation.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | handicapped walker with crutch attachment |
| 15 | walker section |
| 20 | crutch section |
| 25 | hand grip section |
| 30 | legs |
| 35 | side cross sectional support |
| 40 | front interconnecting |
| 45 | folding storage hinges |
| 50 | glide wheels |
| 55 | height adjustable feet |
| 60 | padded support |
| 65 | fore support brace |
| 70 | aft support brace |
| 75 | holes |
| 80 | rubberized hand grip |
| 85 | fore support sleeve |
| 90 | aft support sleeve |
| 95 | height support range arrow |
| 100 | height adjustment mechanism |
| 105 | offset angle |
| 110 | removable rubber plugs members |
| 115 | inner circular member |
| 120 | outer circular member |
| 125 | mounting pin |
| 130 | spring |
| 135 | cap assembly |
| 140 | flange |
| 145 | external opening |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
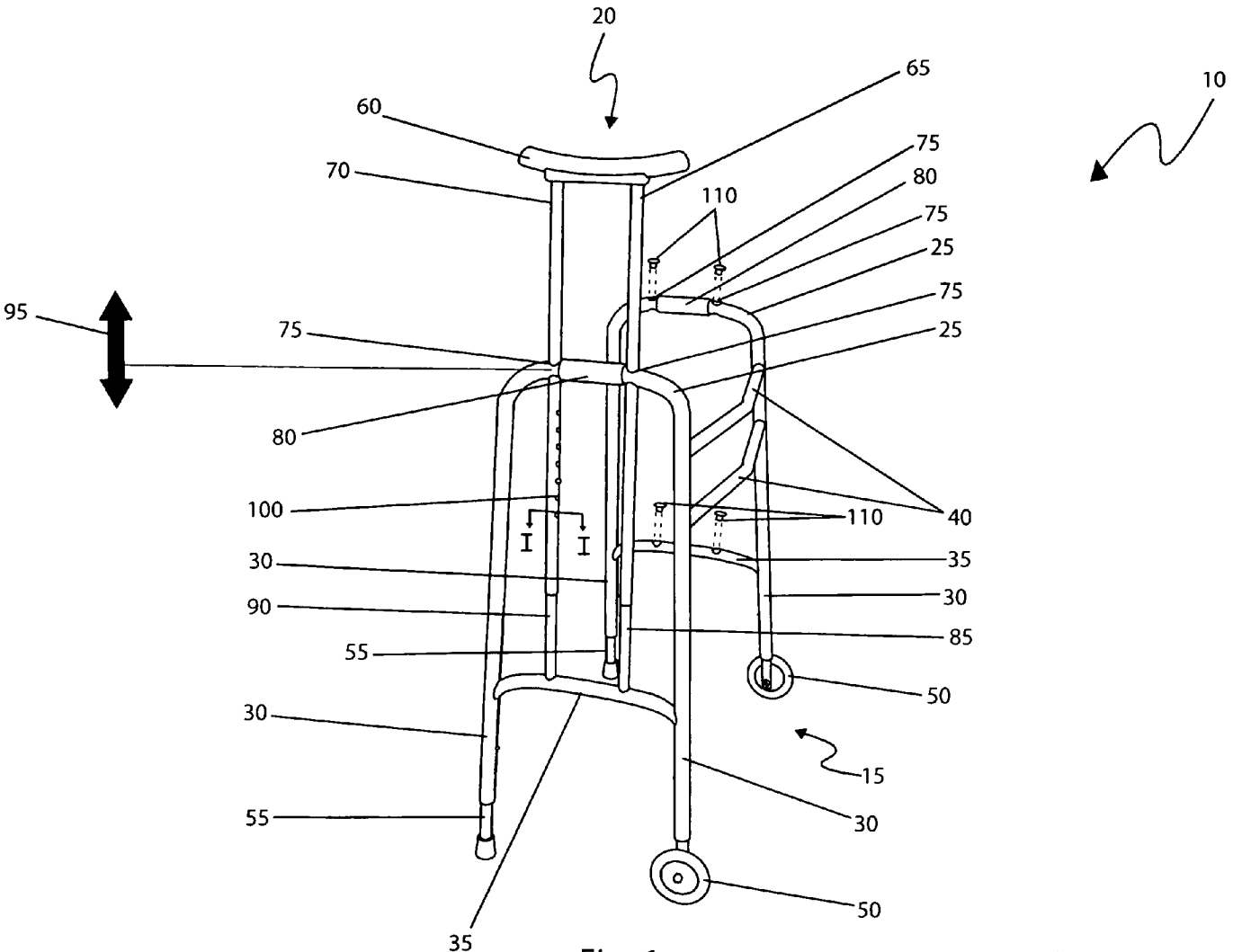
FIG. 1 is an isometric view of the handicapped walker with crutch attachment 10, according to the preferred embodiment of the present invention.

Referring now to FIG. 1, an isometric view of the handicapped walker with crutch attachment 10, according to the preferred embodiment of the present invention is depicted. The handicapped walker with crutch attachment 10 is comprised of a walker section 15 and a crutch section 20. The crutch section 20 is shown on left hand side of the walker section 15 for illustrative purposes, though it should be noted that the crutch section 20 can be provided on the right hand side or both sides of the walker section 15 in an equally effective manner. The walker section 15 is comprised of a hand grip section 25, legs 30, side cross sectional support 35 and front interconnecting members 40 as would be customarily expected in a conventional and standard walker. Optional accessories such as folding storage hinges 45, glide wheels 50, and height adjustable feet 55 can be provided as well which greatly enhance the usability and convenience of the handicapped walker with crutch attachment 10. Said optional accessories are desired, though not necessary, to increase the usability of the handicapped walker with crutch attachment 10. The crutch section 20 consists of a padded support 60 which interconnect to a fore support brace 65 and an aft support brace 70. The construction and materials as used in the padded support 60 as well as the fore support brace 65 and the aft support brace 70 are mostly identical to those used in conventional crutch sets. The fore support brace 65 and the aft support brace 70 extend through a series of holes 75 provided immediately before and after a rubberized hand grip 80 as provided on the hand grip section 25. From there the fore support brace 65 and the aft support brace 70 enter inside of a fore support sleeve 85 and aft support sleeve 90 respectively. The fore support sleeve 85 and the aft support sleeve 90 are physically supported by the hand grip section 25 on the top and the side cross sectional support 35 on the bottom. Such support is envisioned as physically strong enough to support the weight of even the heaviest user. The fore support brace 65 and the aft support brace 70 as well as the fore support sleeve 85 and the aft support sleeve 90 are circular in cross sectional area. Such cross sectional details will be described in greater detail herein below. It should be noted that the outer diameter of the fore support brace 65 and the aft support brace 70 is just slightly smaller than the inside diameter of the fore support sleeve 85 and the aft support sleeve 90. The height of the crutch section 20 can be adjusted up and down with relation to the crutch section 20 as indicated by a height support range arrow 95. Said height relationship would be accomplished by a height adjustment mechanism 100 as shown on the lower part of the fore support sleeve 85 and the aft support sleeve 90. The height adjustment mechanism 100 is envisioned as using a spring pin arrangement which will be described in greater detail herein below. However, other types of height adjustment mechanism 100 such as friction collars, stop pins, set screws and the like could be used with equal effectiveness, and as such, should not be interpreted as a limiting factor of the present invention. This said height adjustment as provide by the handicapped walker with crutch attachment 10 is viewed as allowing the handicapped walker with crutch attachment 10 to be customized for all sizes of users from very small to very large adults.

Figure 2:
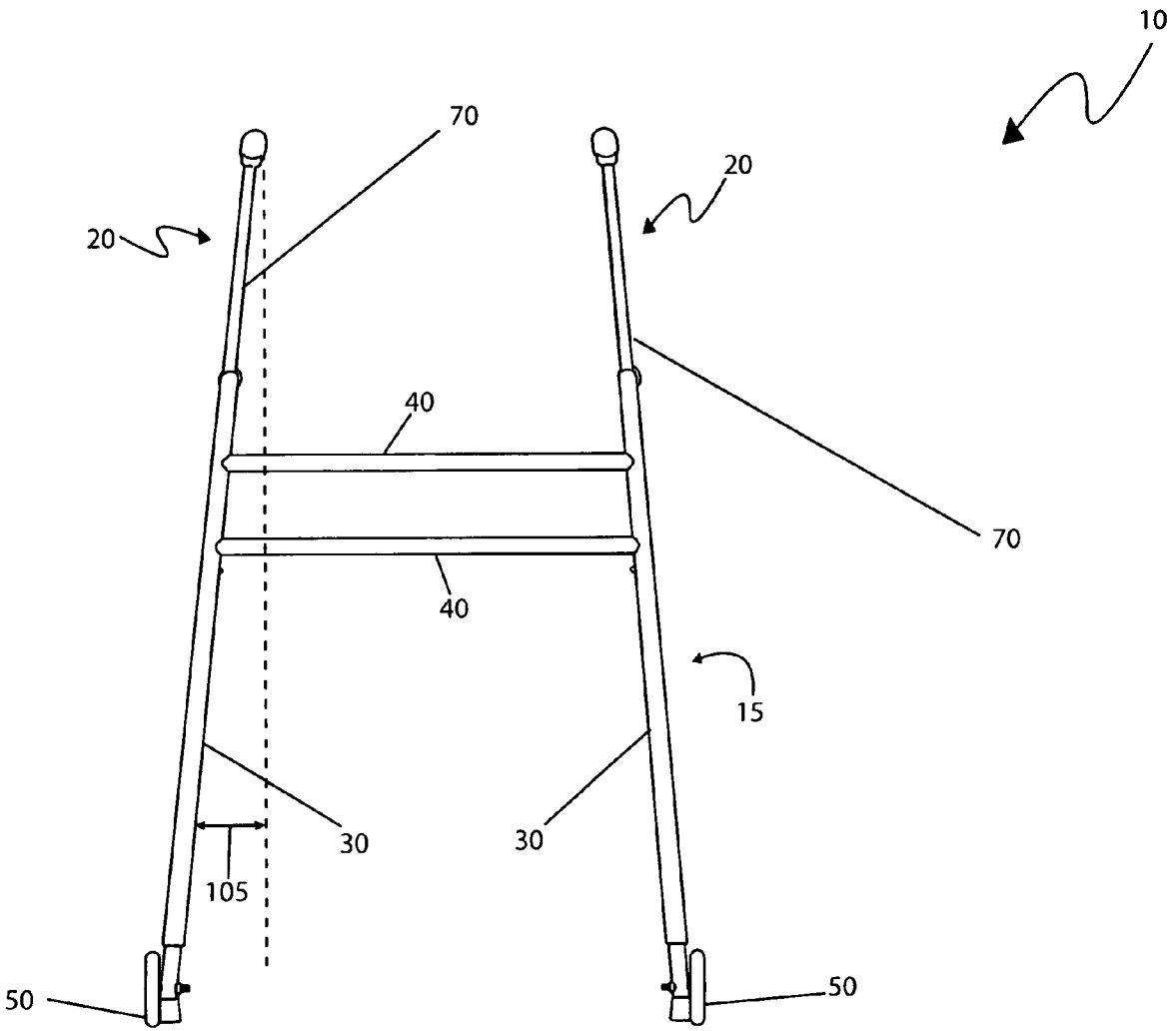
FIG. 2 is a front view of the handicapped walker with crutch attachment 10.

Referring next to FIG. 2, a front view of the handicapped walker with crutch attachment 10 is shown. This figure more clearly depicts the right hand/left hand/both hands arrangement made possible by the adjustable nature of the handicapped walker with crutch attachment 10. For purposes of illustration, the crutch section 20 is shown on the left hand side as previously depicted in FIG. 1. In addition, a crutch section 20 is also shown on the right hand side using hidden lines to illustrate the adaptive nature of the handicapped walker with crutch attachment 10. It should be noted that the right hand and left hand crutch section 20 are independently adjustable with regards to height, and can thus compensate for users who lean to one side or another as a result of a physical shortcoming. To aid in the usage of the crutch section 20, the fore support brace 65 and the aft support brace 70 are provided at an angled relationship to vertical as depicted by an offset angle 105. This feature provides greater comfort and stability by keeping the user centered in between the legs 30 and prevents the handicapped walker with crutch attachment 10 from toppling over during any stumbles.

Figure 3:
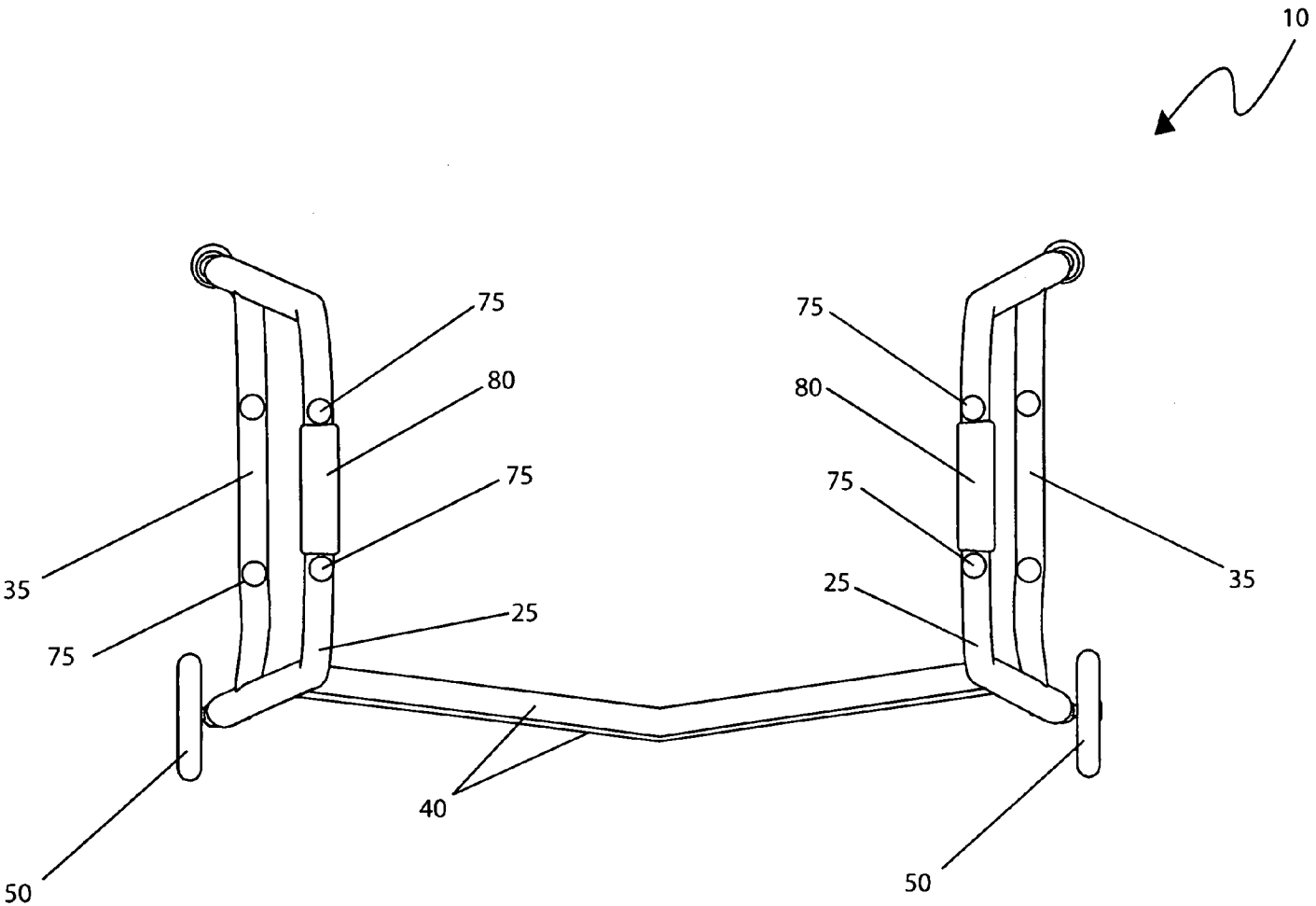
FIG. 3 is a top view of the handicapped walker with crutch attachment 10; and, FIG. 4 is a sectional view of the handicapped walker with crutch attachment 10 as seen along a line I-I as depicted in FIG. 1.

Referring now to FIG. 3, a top view of the handicapped walker with crutch attachment 10 is disclosed. This figure more clearly depicts the four (4) holes 75 as provided in the hand grip section 25. As aforementioned described, the holes 75 accepts the fore support brace 65 (as shown in FIG. 1) and the aft support brace 70 (as shown in FIG. 1). It is envisioned that the handicapped walker with crutch attachment 10 would be supplied with all four (4) holes 75 regardless of the intended use as a right hand/left hand/or both hand model. Should one (1) set or even both sets of holes 75 not be used in a particular configuration, it is envisioned that a set removable rubber plugs 110 would be provided to fingers and other objects from inadvertently entering the holes 75. These removable rubber plugs 110 are envisioned to be held in place by a friction fit. Said fit would provide a near flush surface along the hand grip section 25 thus affording safe use in any configuration.

Figure 4:
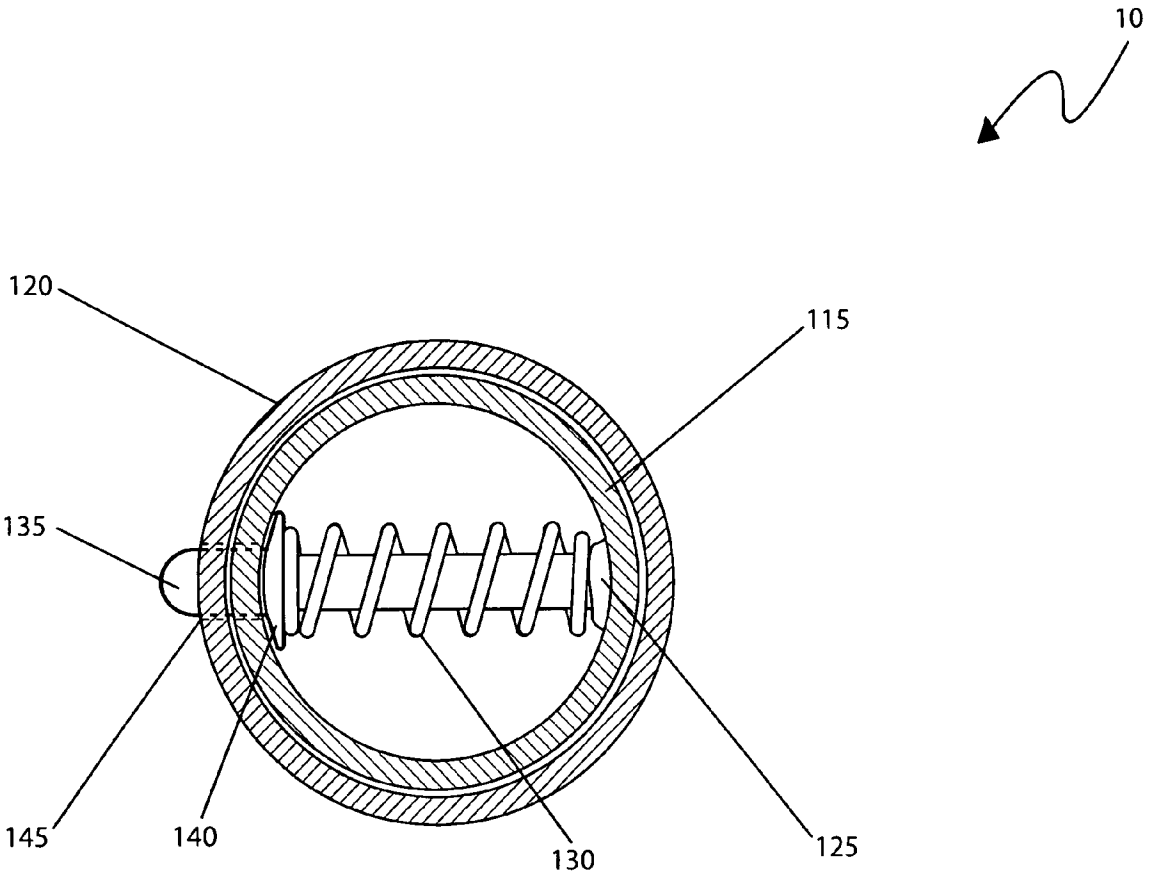

Referring finally to FIG. 4, a sectional view of the handicapped walker with crutch attachment 10 as seen along a line I-I as shown in FIG. 1 is depicted. This figure depicts the internal mechanism of the height adjustment mechanism 100 envisioned and depicted as a spring-pin mechanism. An inner circular member 115 which would be the fore support brace 65 (as shown in FIG. 1) or the holes 75 (as shown in FIG. 1) is located inside of a fore support sleeve 85 (as shown in FIG. 1) or aft support sleeve 90 (as shown in FIG. 1). A mounting pin 125 is provided and attached to the interior surface of the inner circular member 115 as shown. A spring 130 is mounted on the exterior surface of the mounting pin 125 and acts against the inner circular member 115 and a cap assembly 135. The cap assembly 135 is held within the inner circular member 115 by use a flange 140 as provided as a formed fitting on the cap assembly 135. In such a manner the user can push the cap assembly 135 in through an external opening 145 on the outer circular member 120 using only their fingers and/or thumbs; no tools are necessary. The inner circular member 115 and the outer circular member 120 can then be adjusted up or down according to the needs of the user. The series of external opening 145 are envisioned to be approximately one inch apart (as shown in FIG. 1) although other spacing criteria could be used as well with equal effectiveness.

It is envisioned that other styles and configurations of the present invention can be easily incorporated into the teachings of the present invention, and only one particular configuration shall be shown and described for purposes of clarity and disclosure and not by way of limitation of scope.

Handicapped walkers are used everyday by the elderly, the disabled, and those recovering from surgery or illness. They are a godsend for restoring mobility and independence while ensuring the user's safety. However, the usage of a walker requires that the user have use of both of their arms in order to move and place the walker with each step. Should the usage of one arm not be available, the user is typically forced to utilize a wheelchair, which while providing mobility, does not restore independence and may even lengthen recovery time due to the lack of exercise associated with walking with a walker. Accordingly, there is a need for a means by which the heath benefits, mobility and independence associated with a walker can be provided to those users who have limited or no use of one arm. The development of the present invention fulfills this need.

The preferred embodiment of the present invention can be utilized by the common user in a simple and effortless manner with little or no training. It is envisioned that the handicapped walker with crutch attachment 10 would be fabricated in general accordance with FIG. 1, FIG. 2, FIG. 3, and FIG. 4. While multiple different materials can be used, it is envisioned that aluminum would be utilized for the hand grip section 25, the legs 30, the side cross sectional support 35, the front interconnecting members 40, the fore support brace 65, the aft support brace 70, the fore support sleeve 85 and the aft support sleeve 90. Other materials such as reinforced plastic could also be considered. The handicapped walker with crutch attachment 10 could be made with or without various accessories such as folding storage hinges 45, the glide wheels 50 and the height adjustable feet 55. At this point in time, the handicapped walker with crutch attachment 10 is ready for purchase by the final consumer.

Before the handicapped walker with crutch attachment 10 can be used by the final user, it would require adjustment for the physical size of the user. If so equipped, the height adjustable feet 55 would be adjusted first to provide an adequate height of the hand grip section 25, in the conventional manner. Next, the crutch section 20 would be placed on the right, left or both sides of the walker section 15 using the holes 75 for initial placement. The height of the padded support 60 would be adjusted so that they fall just underneath the user's armpits in a normal walking stance. At this point in time, the handicapped walker with crutch attachment 10 is ready for actual and continued use.

During utilization of the handicapped walker with crutch attachment 10, the user would place one or both of their armpit areas upon the associated padded support 60 and their hands upon the associated rubberized hand grip 80 and proceed to walk in a forward fashion. The user would straighten up and pick up the entire handicapped walker with crutch attachment 10 with each step and put it down slightly forward of the previous position. Next, the user would use their legs and walk forward. At this point in time, the process would be repeated as required to obtain forward motion.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An apparatus for providing a combined function of a walker and a crutch, said apparatus comprising:

a walker section, said walker section comprising a pair of hand grip sections and pairs of front and rear legs connected thereto respectively, each said hand grip section including a hand grip portion disposed thereon, said walker section further including a plurality of side cross sectional supports intermediately positioned between said front and rear legs respectively and at least one front interconnecting member coupled directly to said front legs, at least one folding storage hinge connected thereto, a pair of glide wheels each connected to a bottom of one of said pair of front legs, and a pair of height-adjustable feet each connected to a bottom of one of said pair of rear legs; and, a crutch section, said crutch section comprising a padded support, a fore support brace and an aft support brace, wherein said padded support is coupled to a top end of said fore support brace and said aft support brace respectively, said fore support brace and said aft support brace are configured to selectively extend through a plurality of holes formed on said hand grip section within said legs, said hand grip portion disposed between said fore support brace and said aft support brace, and said fore and aft support braces are adjustably coupled to a fore support sleeve and an aft support sleeve supported on said cross sectional support respectively for adjusting a height of said padded support of said crutch section with respect to said walker section.

2. The apparatus of claim 1, wherein said plurality of holes comprise a pair of holes located fore each of said pair of hand grip sections and a pair of holes located aft of each of said pair of hand grip sections.

3. The apparatus of claim 1, wherein said fore support brace and said aft support brace are further configured to slidably and linearly enter inside of said fore support sleeve and said aft support sleeve associated therewith, said fore support brace and said aft support brace extending above and below said hand grip sections respectively, said side cross sectional supports being physically supported beneath said fore and aft support sleeves respectively.

4. The apparatus of claim 3, wherein said fore support brace and said aft support brace are circular in cross sectional area, said fore support sleeve and said aft support sleeve further being circular in cross sectional area such that said fore and aft support braces are telescopically engaged with said fore and aft support sleeves respectively.

5. The apparatus of claim 3, wherein an outer diameter of said fore support brace and said aft support brace is smaller than an inside diameter of said fore support sleeve and said aft support sleeve respectively.

6. The apparatus of claim 1, wherein said fore support brace and said aft support brace are provided at an angled relationship to vertical and travel inwardly along a top region of said walker section.

7. The apparatus of claim 1, wherein said apparatus further comprises: a plurality of removable rubber plugs, said plurality of removable rubber plugs are configured to be held in said holes by a friction fit and said friction fit is configured to provide a near flush surface along said hand grip sections respectively.

8. The apparatus of claim 1, wherein said apparatus is formed from a group of material comprising: aluminum, reinforced plastic and any combination thereof.

9. An apparatus for providing a combined function of a walker and a crutch, said apparatus comprising:

a walker section, said walker section comprising a pair of hand grip sections and pairs of front and rear legs connected thereto respectively, each said hand grip section including a hand grip portion disposed thereon, said walker section further including a plurality of side cross sectional supports intermediately positioned between said front and rear legs respectively and at least one front interconnecting member coupled directly to said front legs, at least one folding storage hinge connected thereto, a pair of glide wheels each connected to a bottom of one of said pair of front legs, and a pair of height-adjustable feet each connected to a bottom of one of said pair of rear legs;

a crutch section, said crutch section comprising a padded support, a fore support brace and an aft support brace, wherein said padded support is coupled to a top end of said fore support brace and said aft support brace respectively, said fore support brace and said aft support brace are configured to selectively extend through a plurality of holes formed on said hand grip section within said legs, said hand grip portion disposed between said fore support brace and said aft support brace, and said fore and aft support braces are supported by said cross sectional support; and, a height adjusting mechanism operably coupled to said walker and crutch sections in such a manner that a height of said crutch section is selectively adjusted up and down with respect to said walker section.

10. The apparatus of claim 9, wherein said plurality of holes comprise a pair of holes located fore each of said pair of hand grip sections and a pair of holes located aft of each of said pair of hand grip sections.

11. The apparatus of claim 9, wherein said fore support brace and said aft support brace are further configured to slidably and linearly enter inside of a fore support sleeve and an aft support sleeve associated therewith, said fore support brace and said aft support brace extending above and below said hand grip sections respectively, said side cross sectional supports being physically supported beneath said fore and aft support sleeves respectively.

12. The apparatus of claim 11, wherein said fore support brace and said aft support brace are circular in cross sectional area, said fore support sleeve and said aft support sleeve further being circular in cross sectional area such that said fore and aft support braces are telescopically engaged with said fore and aft support sleeves respectively.

13. The apparatus of claim 9, wherein said height adjustment mechanism comprises:

a spring pin arrangement including an inner circular member, said inner circular member being defined by one of said fore support brace and said plurality of holes;

a mounting pin coupled to an interior surface of said inner circular member;

a spring mounted on an exterior surface of said mounting pin; and, a cap assembly directly affixed about a distal end of said mounting pin.

14. The apparatus of claim 13, wherein said inner circular member is located inside of said fore support sleeve or said aft support sleeve, said spring is configured to act against said inner circular member and said cap assembly is configured to resiliently sit within said inner circular member by using a flange.

15. The apparatus of claim 9, wherein said height adjustment mechanism further comprises: one a plurality of friction collars, a plurality of stop pins, a plurality of set screws and the like.

16. A method for using an apparatus that provides a functionality of a crutch walker, said method comprising the steps of:

a. providing a walker section by providing and connecting a plurality of hand grip sections each having a hand grip portion mounted thereon and a plurality of front and rear legs connected thereto respectively;

b. providing and intermediately positioning a plurality of side cross sectional supports between said front and rear legs respectively;

c. providing and coupling at least one front interconnecting member directly to said front legs;

d. providing a crutch section by providing a padded support, a fore support brace and an aft support brace;

e. coupling said padded support to said fore support brace and said aft support brace respectively;

f. extending said fore support brace and said aft support brace through a plurality of associated holes formed one said hand grip sections within said legs respectively, said hand grip portion disposed between said fore and aft support braces, and coupling the fore support brace and said aft support brace to a fore support sleeve and an aft support sleeve supported on said side cross sectional support respectively;

g. providing and operably coupling a height adjusting mechanism to said crutch section between said support braces and said support sleeves respectively;

h. providing and operably coupling a pair of glide wheels to a bottom of each said pair of front legs thereof said walker section;

i. providing and operably coupling a pair of height-adjustable feet to a bottom of each said pair of rear legs thereof said walker section; and, j. selectively adjusting a height of said crutch section up and down with respect to said walker section.

17. The method of claim 16, further comprising the steps of:

adjusting a height of said hand grip section by adjusting said pair of height-adjustable feet;

placing said crutch section on at least one side of said walker section; and, adjusting a height of said padded support to a position just underneath a user's armpits while the user is positioned in a normal walking stance.

18. The method claim 17, further comprising the steps of:

placing at least one of the user armpits upon an associated one of said padded supports;

placing at least one of the user hands upon an associated one of said hand grip sections;

walking forward in a step-by-step fashion;

picking up said apparatus with each step; and, putting down said apparatus slightly forward of a previous step.

* * * * *